US006402404B1

(12) United States Patent
Tomita et al.

(10) Patent No.: US 6,402,404 B1
(45) Date of Patent: Jun. 11, 2002

(54) SHEET SUPPLY CONTROL APPARATUS AND METHOD FOR PRINTING PRESS

(75) Inventors: Toshikazu Tomita; Satoru Eguchi, both of Ibaragi (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/516,740

(22) Filed: Mar. 1, 2000

(30) Foreign Application Priority Data

Mar. 1, 1999 (JP) ..... 11-053222

(51) Int. Cl.[7] ..... B41J 11/42
(52) U.S. Cl. ..... 400/582; 400/605
(58) Field of Search ..... 400/582, 583, 400/596, 613, 605, 599, 607, 611, 612; 101/365, 350.1, 350.2, 484, 416.1, 350.5, 419, 477, 478

(56) References Cited

U.S. PATENT DOCUMENTS

| | | | | | |
|---|---|---|---|---|---|
| 4,517,221 | A | * | 5/1985 | Holl | 427/8 |
| 4,655,135 | A | * | 4/1987 | Brovman | 101/426 |
| 5,010,820 | A | * | 4/1991 | Loffler | 101/484 |
| 5,070,784 | A | * | 12/1991 | Nishida et al. | 101/365 |
| 5,447,102 | A | * | 9/1995 | Pfeiffer et al. | 101/492 |
| 5,791,251 | A | * | 8/1998 | Kistler et al. | 101/484 |
| 5,884,562 | A | | 3/1999 | Sugiyama | |
| 5,904,428 | A | * | 5/1999 | Shimamura | 400/582 |
| 5,921,184 | A | | 7/1999 | Sugiyama | |
| 5,966,157 | A | * | 10/1999 | Dolan | 347/103 |
| 5,988,067 | A | * | 11/1999 | Ishida et al. | 101/484 |

FOREIGN PATENT DOCUMENTS

| | | |
|---|---|---|
| DE | 926 666 | 6/1955 |
| DE | 20 29 623 | 12/1971 |
| GB | 1 552 479 | 12/1976 |
| JP | U55-85834 | 6/1980 |

* cited by examiner

*Primary Examiner*—John S. Hilten
*Assistant Examiner*—Darius N. Cone
(74) *Attorney, Agent, or Firm*—Blakely Sokoloff Taylor & Zafman

(57) ABSTRACT

A sheet supply control apparatus for a printing press includes a sucker, a memory, a sheet detector, a counter, and a CPU. The sucker supplies sheets to a printing unit one by one with a predetermined supply interval. A count of sheets to be supplied to the printing unit is set in the memory. The sheet detector detects the sheets supplied from the sucker. The counter counts sheets supplied from the sucker after the sheet detector detects a first sheet. The CPU controls supply operation of the sucker, on the basis of the count preset in the memory and the count of the counter, such that the count of sheets supplied from the sucker coincides with the count preset in the memory. A sheet supply control method for a printing press is also disclosed.

10 Claims, 7 Drawing Sheets

SHEET SUPPLY CONTROL APPARATUS AND METHOD FOR PRINTING PRESS

BACKGROUND OF THE INVENTION

The present invention relates to a sheet supply control apparatus and method for a printing press which supply sheet-like printing products to a printing unit one by one.

FIG. 6 shows the main part of an ink supply unit in the printing unit of a web offset printing press.

Referring to FIG. 6, an ink fountain 1 stores an ink 2. An ink fountain roller 3 supplies the ink 2 in the ink fountain 1 to an ink roller group 6. A plurality of ink fountain keys 4 are aligned in the axial direction of the ink fountain roller 3. An ink ductor roller 5 is arranged between the ink fountain roller 3 and ink roller group 6. A printing plate 7 is mounted on a plate cylinder 20.

In this ink supply unit, the ink 2 in the ink fountain 1 is supplied to the ink fountain roller 3 by adjusting the aperture ratios of the ink fountain keys 4. The ink 2 supplied to the ink fountain roller 3 is supplied to the printing plate 7 through the ink roller group 6 which is rotated in accordance with the feed operation of the ink ductor roller 5 in the operation of the printing press.

In the web offset printing press, when the printing plate is changed to a new printing plate 7, the aperture ratios of the ink fountain keys 4 and the rotation ratio of the ink fountain roller 3 are preset as preset data to values corresponding to the image of the printing plate 7. More specifically, the aperture ratios of the ink fountain keys 4 and the rotation ratio of the ink fountain roller 3 are set to values corresponding to the image of the new printing plate 7, and the ink 2 in the ink fountain 1 is supplied to the printing plate 7 through the ink roller group 6. In this case, test printing is performed before final printing to adjust the ink supply amount, thereby obtaining a satisfactory color tone. With this operation, a desired ink film thickness distribution (gradient of thickness of the ink film) is formed on the ink roller group 6.

In the conventional ink supply unit, however, when the printing plate is changed to the new printing plate 7 from the previous one, the ink film thickness distribution corresponding to the image on the previous printing plate remains on the ink roller group 6. For this reason, the ink film thickness distribution for the previous printing plate must be gradually changed to the ink film thickness distribution for the new printing plate 7. This operation excessively requires adjustment of the ink supply amount and test printing until a satisfactory color tone is obtained, resulting in various problems including an increase in preparation time for printing, an increase in work load, waste of printing materials, a decrease in production efficiency, and an increase in cost.

In order to decrease the numbers of operation times of adjustment of the ink supply amount and test printing that must be done until a satisfactory color tone is obtained, the present applicant/assignee proposed "Ink Film Thickness Control Method for Ink Supply Apparatus" in U.S. Pat. Nos. 5,884,562 and 5,921,184. According to this ink film thickness control method, when the previous printing plate is to be exchanged to a new printing plate 7, an ink removing (deletion of ink history) operation is performed first.

In the ink removing operation, first, printing on a predetermined count of blank sheets is performed with the previous printing plate being mounted on the plate cylinder. In this case, after printing with the previous printing plate is completed, the blank sheet printing count is set, and the ink removing mode is selected on the operation panel. While the feed operation of an ink ductor roller 5 is stopped, the printing press is operated at a predetermined operation speed, and printing is performed for the preset blank sheet printing count.

At this time, on an ink roller group 6, a second ink film thickness distribution Mb (see FIG. 7B) corresponding to the image of the previous printing plate is superposed on a minimum first ink film thickness distribution Ma (see FIG. 7A) the thickness of which decreases from the upstream side to the downstream side and which is required during printing. When the feed operation of the ink ductor roller 5 is turned off and the printing press is operated with the previous printing plate being mounted, the ink on the ink roller group 6 is consumed, and its film thickness decreases gradually. In this case, the ink is consumed much on a zone having many images, and is consumed less on a zone having few images. After printing is performed for the preset blank sheet printing count, the first ink film thickness distribution Ma is left on the ink roller group 6.

In this case, the blank sheet printing count which is preset for ink removing can be obtained from preset data for final data of the previous printing plate. More specifically, an ink supply amount is obtained from the preset data for final printing, and the second ink film thickness distribution Mb left on the ink roller group 6 is obtained from the obtained ink supply amount. The relationship between the second ink film thickness distribution Mb and the blank sheet printing count is obtained through tests in advance in the form of a table. Therefore, when the table data is looked up with reference to the obtained second ink film thickness distribution Mb, the blank sheet printing count necessary for leaving the first ink film thickness distribution Ma can be obtained. The obtained blank sheet printing count can be freely set or changed by the operator through a ten-key pad and the like.

In this manner, ink removing is ended with the first ink film thickness distribution Ma left on the ink roller group 6. After ink removing, the operator cleans the blanket, and changes the previous printing plate to the new printing plate 7.

In the web offset printing plate described above, sheets are supplied to the printing unit for ink removing as shown in FIG. 8. Referring to FIG. 8, a sheet detector 9 is set at a terminal end (front lay) 8*a* of a feeder board 8 to detect sheets 11 attracted by a sucker 10 and supplied onto the feeder board 8 one by one. In this case, after the first sheet 11 is detected, every time the sheet 11 is supplied, a pulse (timing pulse of the printing press) generated by a pulse generator (rotary encoder) is counted. When the number of pulses becomes equal to the preset blank sheet printing count, the sheet supply operation of the sucker 10 is stopped, and the operation of the printing press is stopped.

Therefore, in the conventional case, after printing for the preset blank sheet count is performed, a sheet 11 remains on the feeder board 8 between the sucker 10 and sheet detector 9. This sheet 11 must be removed, posing a load to the operator. The removed sheet 11 is discarded, which is a waste.

SUMMARY OF THE INVENTION

It is an object of the present invention to provide a sheet supply control apparatus and method for a printing press, in which, after printing for a preset printing count is performed, an operation of removing a sheet on a supply path to a printing unit need not be performed.

In order to achieve the above object, according to the present invention, there is provided a sheet supply control apparatus for a printing press, comprising sheet supply means for supplying sheet-like objects to a printing unit one by one with a predetermined supply interval, setting means in which a count of sheet-like objects to be supplied to the printing unit is set, detection means for detecting the sheet-like objects supplied from the sheet supply means, count means for counting sheet-like objects supplied from the sheet supply means after the detection means detects a first sheet-like object, and sheet supply control means for controlling supply operation of the sheet supply means, on the basis of the count preset in the setting means and the count of the count means, such that the count of sheet-like objects supplied from the sheet supply means coincides with the count preset in the setting means.

DESCRIPTION OF THE PREFERRED EMBODIMENTS

The present invention will be described in detail with reference to the accompanying drawings.

[First Embodiment]

Figure 8:
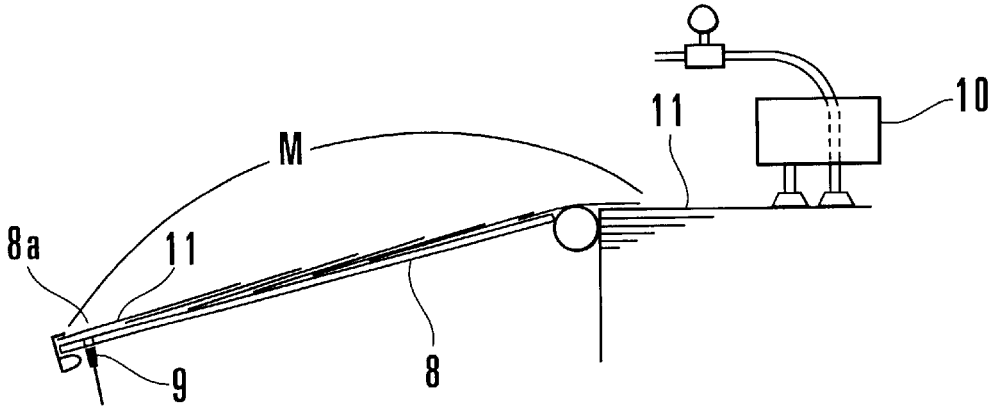
FIG. 8 PRIOR ART
FIG. 8 is a view showing a position where a sheet detector is set in the prior art and in the first embodiment.

According to the first embodiment, in the same manner as in FIG. 8, a sheet detector 9 is set at a terminal end (front lay) 8*a* of a feeder board 8. Paper sheets 11 as sheet-like objects supplied onto the feeder board 8 with a predetermined supply interval by a sucker 10 are detected by the sheet detector 9. After the first sheet 11 is detected by the sheet detector 9, the subsequently supplied sheets 11 are sequentially counted. When the supply count (count) of the sheets 11 after initial detection becomes equal to the difference between a preset blank sheet printing count (the number of sheets 11 that should be supplied to the printing unit) N and a stored sheet supply count M (to be described later), the sheet supply operation of the sucker 10 is stopped.

The number of sheets 11 fed onto the feeder board 8 by the sucker 10 since the sucker 10 starts sheet supply operation until the sheet detector 9 detects the first sheet 11 is known. This known count is stored in a memory in advance as the count M of sheets supplied to the sheet detector 9 (this will be referred to as the sheet supply count M hereinafter).

Figure 1:
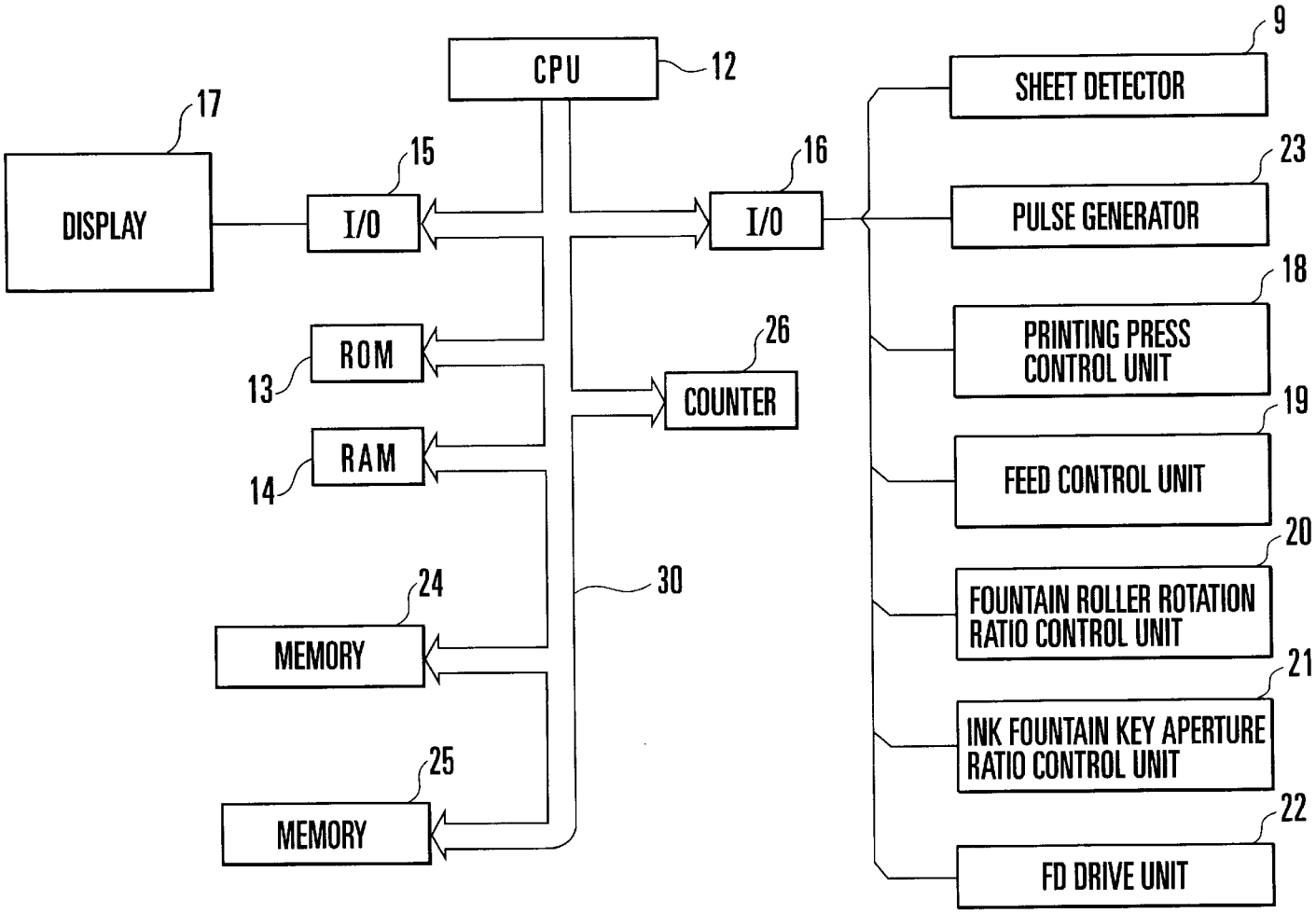
FIG. 1 is a block diagram of a sheet supply control apparatus for a printing press according to the first embodiment of the present invention.

FIG. 1 shows a sheet supply control apparatus for a printing press according to this embodiment.

Referring to FIG. 1, the sheet supply control apparatus has a CPU (Central Processing Unit) 12, a ROM (Read-Only Memory) 13, a RAM (Random Access Memory) 14, a touch panel display 17, a printing press control unit 18, a feed control unit 19, a fountain roller rotation ratio control unit 20, an ink fountain key aperture ratio control unit 21, a floppy disk drive unit 22, a pulse generator 23, memories 24 and 25, and a counter 26. The feed control unit 19 turns on/off a feed mechanism. The pulse generator 23 is comprised of a rotary encoder which generates a pulse every time one sheet 11 is supplied. The memory 24 stores the sheet supply count M described above. The memory 25 stores the blank sheet printing count N set on the display 17.

The sheet detector 9, printing press control 18, feed control unit 19, rotation ratio control unit 20, aperture ratio control unit 21, drive unit 22, and pulse generator 23 are connected to an I/O interface 16, and the display 17 is connected to an I/O interface 15. The ROM 13, RAM 14, I/O interfaces 15 and 16, memories 24 and 25, and counter 26 are connected to the CPU 12 through a bus 30.

Upon reception of various types of input information supplied through the I/O interfaces 15 and 16, the CPU 12 performs various types of processing operations in accordance with a program stored in the ROM 13 while accessing the RAM 14. The various types of input information in the CPU 12 are output to the display 17, printing press control unit 18, feed control unit 19, rotation ratio control unit 20, aperture ratio control unit 21, and drive unit 22 through the I/O interfaces 15 and 16.

Figure 2:
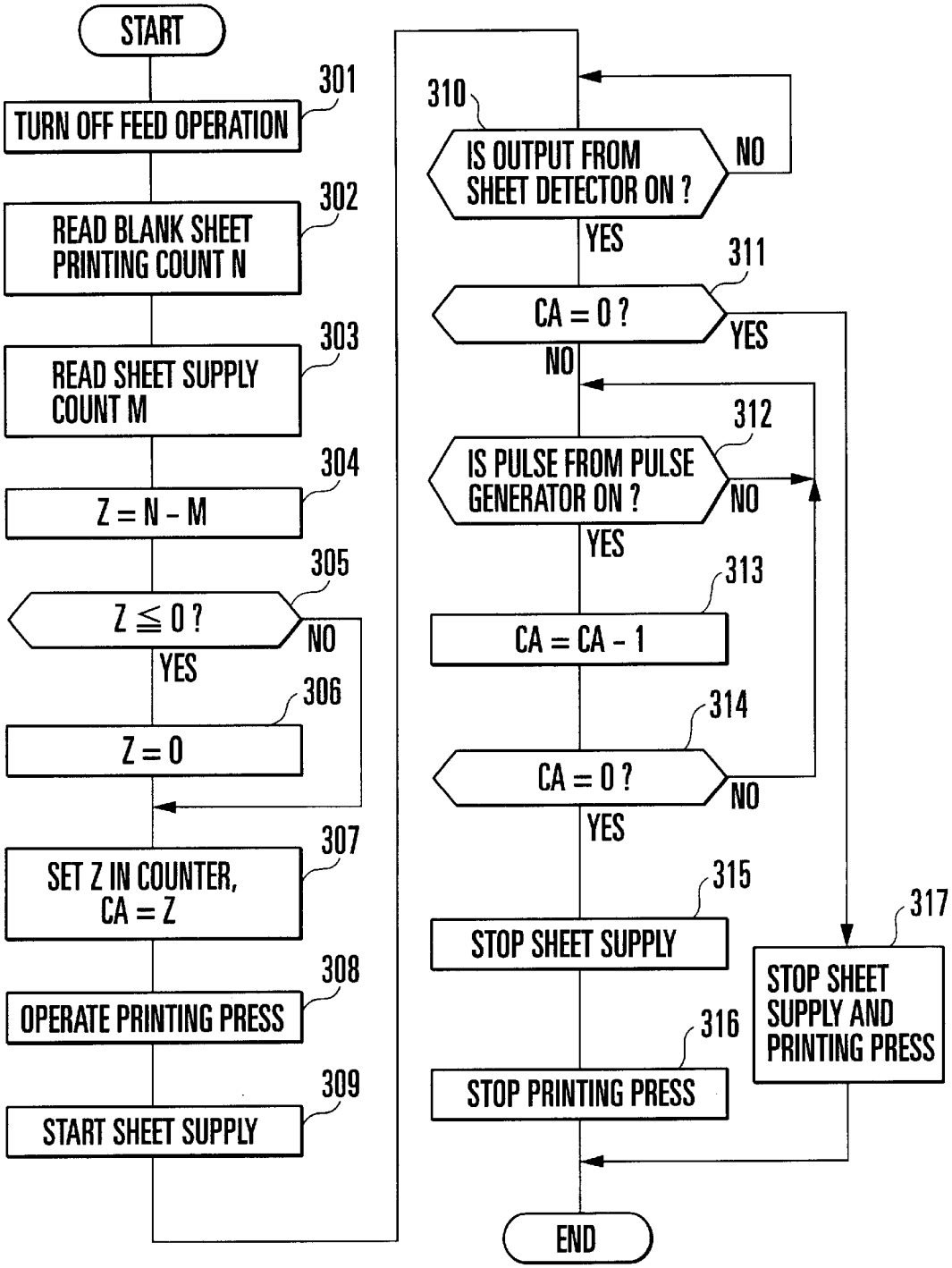
FIG. 2 is a flow chart showing ink removing operation performed by the sheet supply control apparatus of FIG. 1.

Ink removing operation performed before the printing plate is changed will be described with reference to FIG. 2.

When printing with the previous plate is ended, a blank sheet printing count N is set, and the ink removing mode is selected on the display 17. The preset blank sheet printing count N is stored in the memory 25. When the ink removing mode is started, the CPU 12 sends an instruction to the feed control unit 19 to stop the feed operation of an ink ductor roller 5 (step S301).

Subsequently, the CPU 12 reads out the blank sheet printing count N from the memory 25 (step S302), and the sheet supply count M from the memory 24 (step S303). Then, the CPU 12 calculates a difference Z between the readout blank sheet printing count N and sheet supply count M (Z=N−M) (step S304), and checks whether Z≦0 (step S305).

Assume that the blank sheet printing count N is set at 10 and that the sheet supply count M is set at 4. In this case, since the difference Z between the blank sheet printing count N and sheet supply count M is 6, Z=6 is set as a count CA in the counter 26 in step S307. The CPU 12 then operates the printing press at a predetermined operation speed (step S308) to start sheet supply operation with the sucker 10 (step S309).

Hence, the sheets 11 are sequentially sent onto a feeder board 8 (FIG. 8), and conveyance of the sheets 11 to the printing unit is started. At this time, when a sheet detector 9 detects that the first sheet 11 is supplied (step S310), the CPU 12 starts counting pulses sent from the pulse generator 23.

More specifically, the CPU 12 checks whether the count CA of the counter 26 is 0 (step S311). Since the count CA is set at 6, when the pulse generator 23 generates a pulse, 1 is subtracted from the count CA (steps S312, S313). The CPU 12 then checks whether the count CA is 0 (step S314). The processes of steps S312, S313, and S314 are repeated until the count CA becomes 0.

The pulse generator 23 generates a pulse every time one sheet 11 is supplied. After the sheet detector 9 detects the first sheet 11, when sheets 11 in a count that renders Z=6 are supplied by the sucker 10 onto the feeder board 8, the count CA becomes 0. In step S314, if CA=0, i.e., if the count C of the counter 26 becomes equal to the difference between the blank sheet printing count N and the count M of sheets supplied to the sheet detector 9 (C=N−M), the CPU 12 stops the sheet supply operation of the sucker 10 (step S315).

After 4 (=M) sheets 11 are supplied onto the feeder board 8 in this manner, when 6 (=C) sheets 11 are supplied, the operation of supplying the sheets 11 by the sucker 10 is stopped. As a result, a total of 10 (=M+C) sheets have been supplied onto the feeder board 8. Therefore, when the operation of the printing press is continued even after the sheet supply operation of the sucker 10 is stopped, printing for the preset N blank sheets can be performed without leaving any sheet 11 on the feeder board 8.

After the sheet supply operation by the sucker 10 is stopped, at least all the blank sheets 11 left on the feeder board 8 are printed, and after that the operation of the printing press is stopped (step S316).

In step S305, if Z≦0, the flow advances to step S306 to set Z=0. More specifically, if the blank sheet printing count N is equal the sheet supply count M or less, Z=0 is set in step S306. For example, when the count M of sheets supplied to the sheet detector 9 is 6 and the blank sheet printing count N is 2, since N −M=−4, Z=0 is set. The count CA of the counter 26 is set at 0 (step S307), and the operation of a printing press and sheet supply operation by the sucker 10 are started (steps S308 and S309).

When the sheet detector 9 detects the first sheet 11 in step S310, the sheet supply operation of the sucker 10 and the operation of the printing press are immediately stopped in step S317. Note that in this case, 4 sheets 11 are left on the feeder board 8.

In the first embodiment, the sheet detector 9 is provided to the terminal end 8*a* of the feeder board 8. However, the position of the sheet detector 9 is not limited to that on the feeder board 8. For example, a missing sheet sensor may be provided downstream of a feeder board 8 and be used as a sheet detector 9. A missing sheet sensor is a sensor for constantly detecting a sheet gripped by a gripper unit and conveyed from a transfer cylinder to an impression cylinder. When the missing sheet sensor cannot detect a sheet, it is determined that a sheet is dropped from the gripper unit.

More specifically, the sheet detector 9 may be arranged at a position downstream or upstream of the position shown in FIG. 1 as far as the distance from the sucker 10 to the sheet detector 9 is longer than the supply interval of the sheets 11.

[Second Embodiment]

In the first embodiment, when the blank sheet printing count N is less than the sheet supply count M, the sheet 11 is left on the feeder board 8. Therefore, when the blank sheet printing count N is less than the sheet supply count M, the sheets must be supplied in the desired count N by the manual operation of the operator, thus performing ink removing operation.

The blank sheet printing count N for ink removing changes depending on various types of printing conditions (the material, the preset condition of the printing press, the printing density reference, and the like), and is thus sometimes equal to the sheet supply count M or less.

Figure 3:
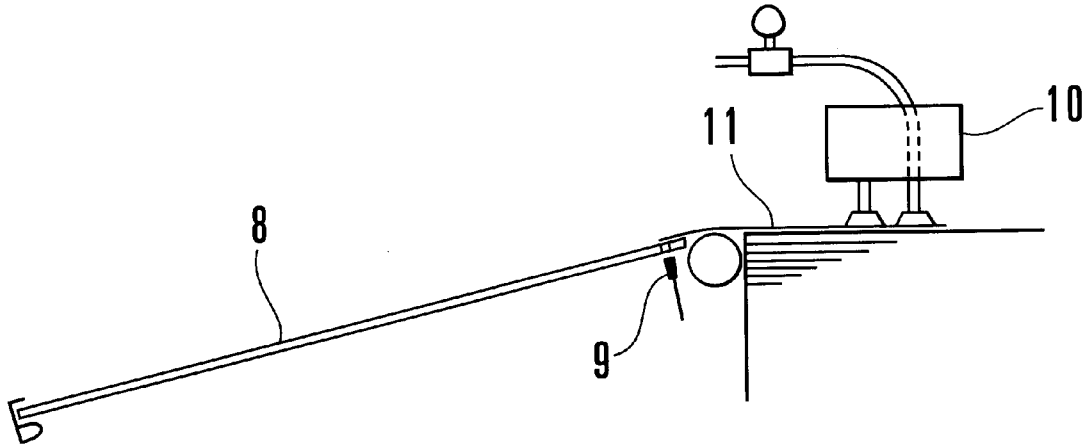
FIG. 3 is a view showing a position where the sheet detector shown in FIG. 4 is set.

In the second embodiment, even when the blank sheet printing count N is less than the sheet supply count, printing of preset N blank sheets can be performed without leaving any sheet 11 on the feeder board 8. In order to realize this, as shown in FIG. 3, a sheet detector 9 is provided to the most upstream portion, close to a sucker 10, of the feeder board 8. When the first sheet 11 is started to be fed to the feeder board 8 by the sucker 10, the sheet detector 9 detects it immediately.

In FIG. 1, the sheet detector 9 is arranged at the most upstream portion of the feeder board 8. It suffices if the sheet detector 9 is arranged at such a position that it can detect the first sheet 11 since the first sheet 11 is started to be fed to the feeder board 8 and before the next sheet 11 is started to be fed there. More specifically, the sheet detector 9 may be arranged downstream or upstream of the position shown in FIG. 3 as far as the distance from the sucker 10 to the sheet detector 9 is shorter than the supply interval of the sheets 11.

Figure 4:
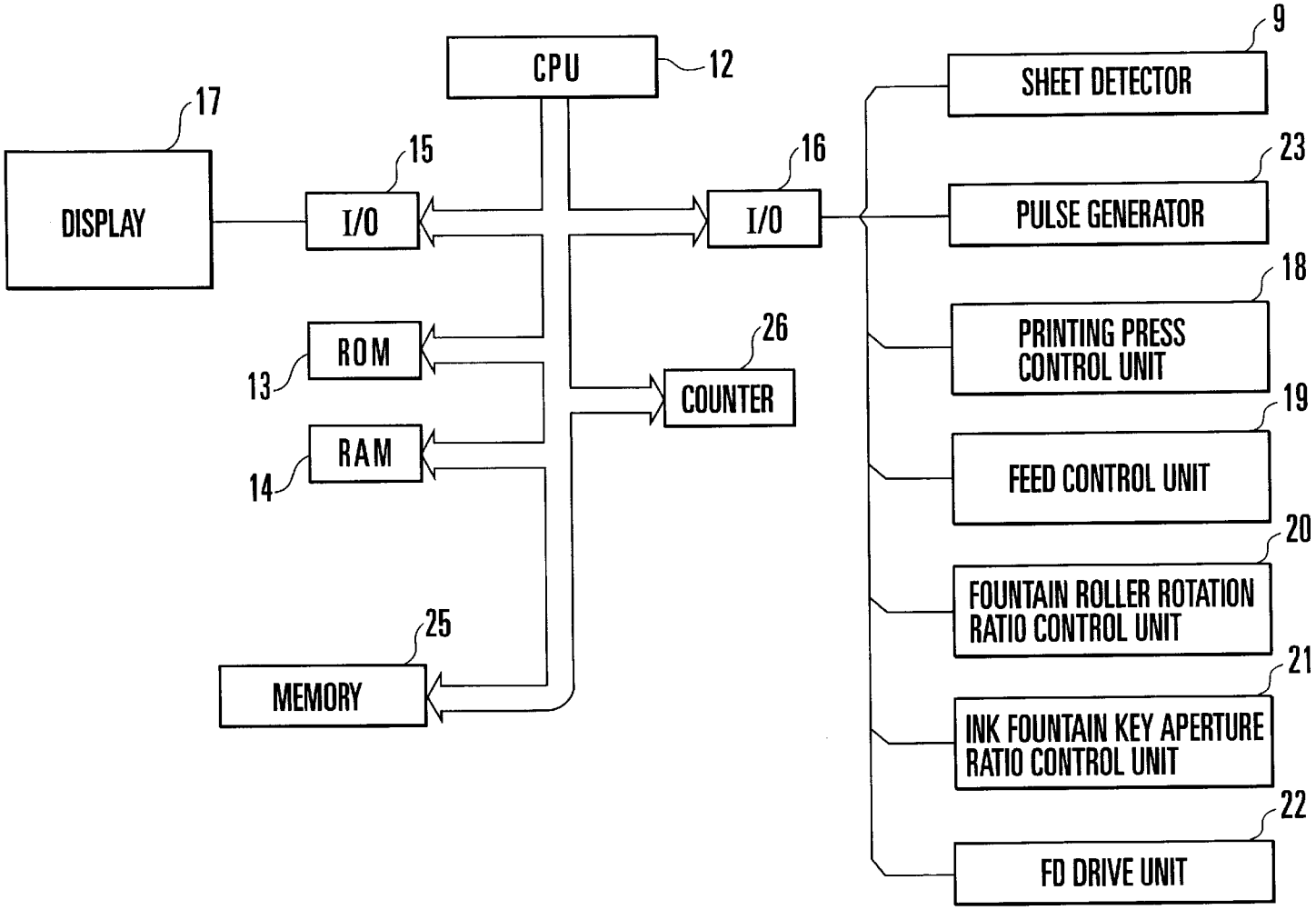
FIG. 4 is a block diagram of a sheet supply control apparatus for a printing press according to the second embodiment of the present invention.

FIG. 4 shows a sheet supply control apparatus for a printing press according to the second embodiment. In FIG. 4, portions that are identical to those in FIG. 1 are denoted by the same reference numerals as in FIG. 1, and a detailed description thereof will be omitted. FIG. 4 is different from FIG. 1 in that the memory 24 shown in FIG. 1 for setting the sheet supply count is omitted.

Figure 5:
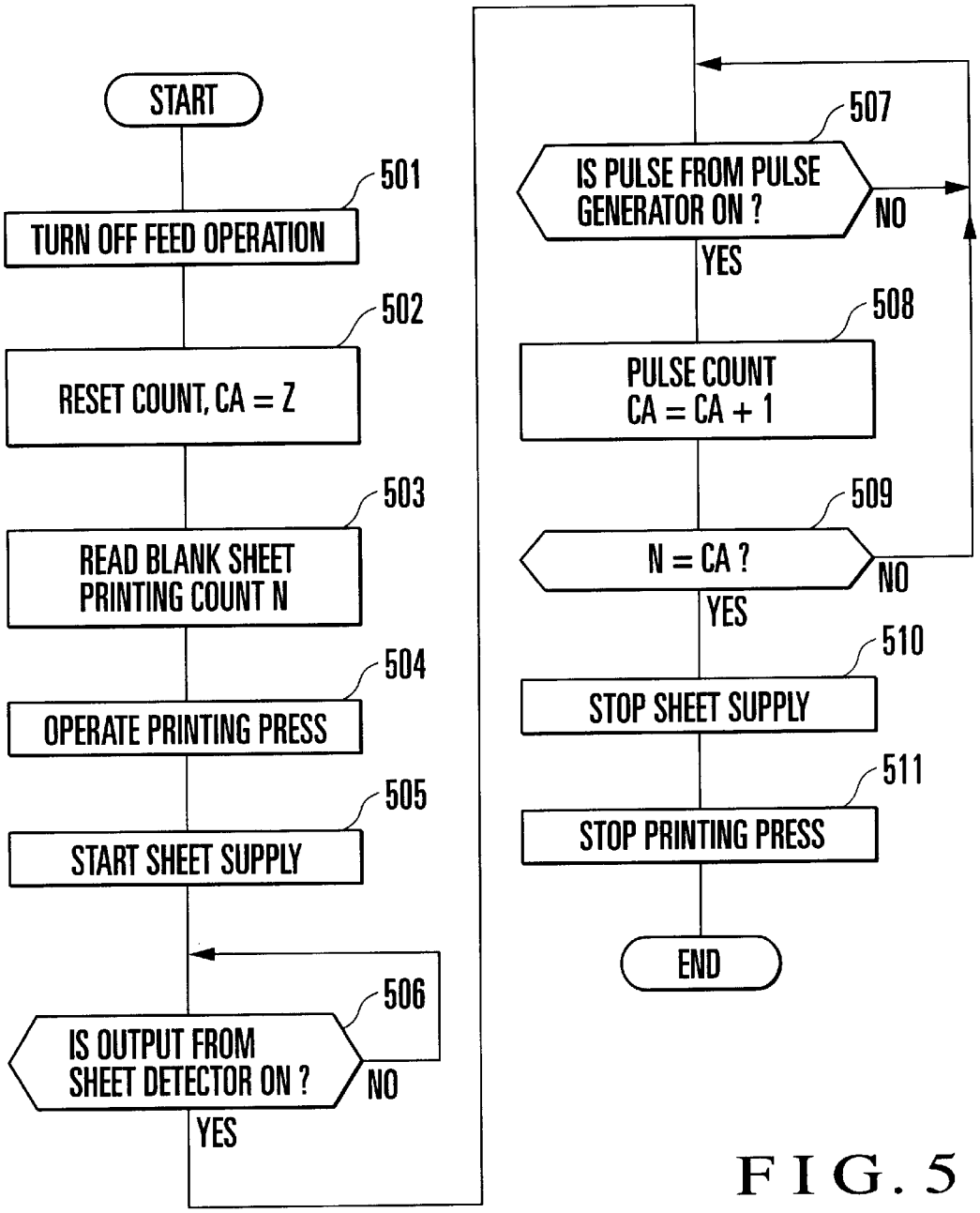
FIG. 5 is a flow chart showing ink removing operation performed by the sheet supply control apparatus of FIG. 4.
Figure 6:
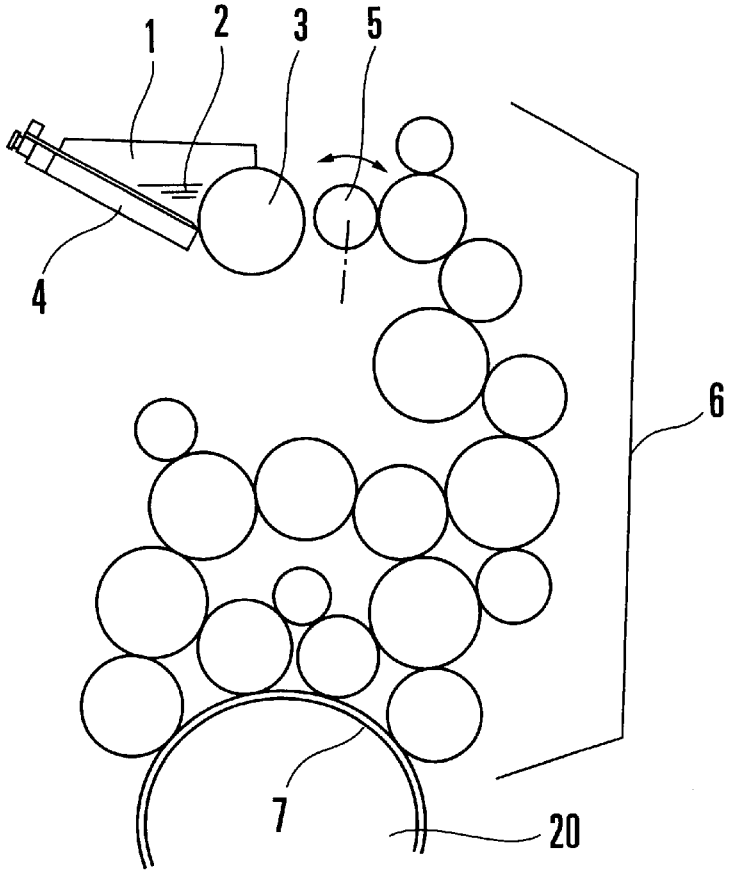
FIG. 6 PRIOR ART
FIG. 6 is a view schematically showing an ink supply unit in the printing unit of a web offset printing press.
Figure 7A:
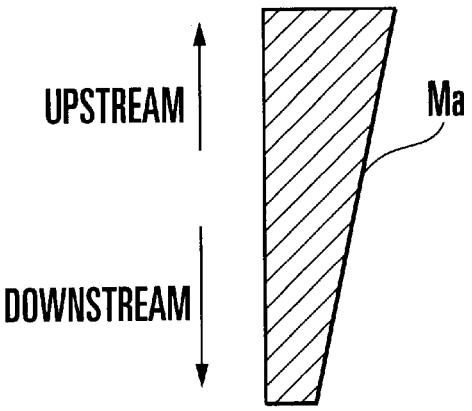
FIGS. 7A and 7B are views showing ink film thickness distributions Ma and Mb, respectively, formed on an ink roller group.
Figure 7B:
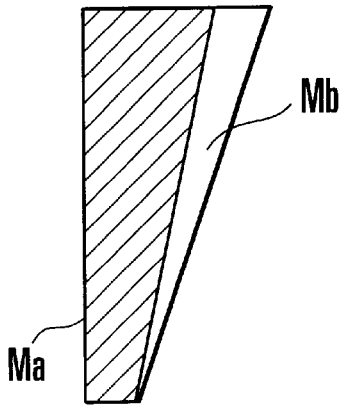

Ink removing operation performed before the printing plate is changed will be described with reference to FIG. 5.

When printing with the previous plate is ended, a blank sheet printing count N is set in the same manner as in the first embodiment, and the ink removing mode is selected on a display 17. The preset blank sheet printing count N is stored in a memory 25. A CPU 12 sends an instruction to a feed control unit 19 to stop the feed operation of an ink ductor roller 5 (step S501).

The CPU 12 then resets a count CA of a counter 26 to 0 (step S502), and reads out the blank sheet printing count N from the memory 25 (step S503). After that, the CPU 12 operates the printing press at a predetermined operation speed (step S504), to start sheet supply operation with the sucker 10 (step S505).

When the sheet detector 9 detects the first sheet 11 (step S506), the CPU 12 starts counting pulses sent from a pulse generator 23. More specifically, every time the pulse generator 23 generates a pulse, the CPU 12 increments the count CA of the counter 26 by one (steps S507 and S508), and checks whether N=CA (step S509). After that, the process operations of steps S507, S508, and S509 are repeated until N=CA is obtained in step S509.

The pulse generator 23 generates a pulse every time one sheet 11 is supplied. After the sheet detector 9 detects the first sheet 11, when N sheets 11 are supplied onto the feeder board 8, N=CA is obtained in step S509. When N=CA is obtained in step S509, that is, when a count C of the counter 26 becomes equal to the blank sheet printing count N (C=N), the CPU 12 stops the sheet supply operation of the sucker 10 (step S510).

Hence, when N sheets 11 are supplied to the feeder board 8, the operation of supplying the sheets 11 with the sucker 10 is stopped. Therefore, when the operation of the printing press is continued even after the sheet supply operation of the sucker 10 is stopped, printing for the preset N blank sheets can be performed without leaving any sheet 11 on the feeder board 8.

After the sheet supply operation by the sucker 10 is stopped, all the blank sheets 11 left on the feeder board 8 are printed. Then, the operation of the printing press is stopped (step S511).

In the second embodiment, even if the blank sheet printing count N is 1, printing for the preset N count can be performed without leaving any sheet 11 on the feeder board 8. Also, a complicated ink removing process as in the first embodiment is not required, so that the load on the CPU 12 is reduced.

In place of the sheet detector 9 which directly detects the sheet 11, a pressure sensor may be provided to the pipe path of the suction port air of the sucker 10. The pressure sensor detects a pressure drop occurring when the sheet 11 is attracted, and this timing is used as a sheet supply start timing.

According to the embodiments described above, the sheet detector 9 is arranged at the most upstream portion of the feeder board 8, or the pressure sensor is provided to the pipe path of the suction port air of the sucker 10. When compared to a case wherein the ON timing of the air valve of the sucker 10 is detected as a sheet supply start timing, the sheet supply start timing can be detected reliably.

In the embodiments described above, the printing product is a paper sheet. However, the printing product is not limited to a paper sheet but can be of any type as far as it is a sheet-like printing product.

As has been described above, according to the present invention, printing for the preset count N can be performed without leaving any printing product on the sheet supply path. This can reduce the load to the operator and eliminate waste paper.

Even if the blank sheet printing count is 1, ink removing operation can be performed without requiring a complicated process.

What is claimed is:

1. A sheet supply control apparatus for a printing press, comprising:

sheet supply means for supplying sheet-like objects to a printing unit one by one with a predetermined supply interval;

setting means in which a count of sheet-like objects to be supplied to said printing unit is set;

detection means for at least detecting a first sheet-like object supplied by said sheet supply means;

count means for counting the number of sheet-like objects supplied by said sheet supply means after said detection means detects the first sheet-like object;

sheet supply control means for controlling supply operation of said sheet supply means;

wherein said detection means and said sheet supply means are positioned at a distance greater than the predetermined supply interval for the sheet-like objects supplied by said sheet supply means;

first storage means for storing a count of sheet-like objects supplied by said sheet supply means since supply operation of said sheet supply means is started until said detection means detects the first sheet-like object supplied by said sheet supply means;

wherein said sheet supply control means stops supply operation of said sheet supply means when the count of said count means becomes equal to a difference between the count preset in said setting means and the count stored in said first storage means such that the count of sheet-like objects supplied by said sheet supply means coincides with the count preset in said setting means; and a feeder board provided between said printing unit and said sheet supply means, and said detection means is comprised of a sheet detector which is arranged at an end portion of said feeder board on a side of said printing unit to detect the sheet-like objects supplied by said sheet supply means.

2. A sheet supply control apparatus for a printing press, comprising:

sheet supply means for supplying sheet-like objects to a printing unit one by one with a predetermined supply interval;

setting means in which a count of sheet-like objects to be supplied to said printing unit is set;

detection means for at least detecting a first sheet-like object supplied by said sheet supply means;

count means for counting the number of sheet-like objects supplied by said sheet supply means after said detection means detects the first sheet-like object;

sheet supply control means for controlling supply operation of said sheet supply means, on the basis of the count preset in the setting means and the count of said count means, such that the count of sheet-like objects supplied by said sheet supply means coincides with the count preset in said setting means;

wherein said detection means and said sheet supply means are set at a distance shorter than the predetermined supply interval of the sheet-like objects supplied by said sheet supply means;

wherein said sheet supply control means stops supply operation of said sheet supply means when the count of said count means coincides with a printing count preset in said setting means; and a feeder board provided between said printing unit and said sheet supply means, and wherein said detection means is comprised of a sheet detector which is arranged at an end portion of said feeder board on a side of said sheet supply means to detect the sheet-like objects supplied by said sheet supply means.

3. An apparatus according to claim 1, wherein the count preset in said setting means is a printing count of sheet-like objects necessary for ink removing operation, performed prior to exchange to a new printing plate, that removes an ink film thickness distribution corresponding to an image of a previous printing plate.

4. An apparatus according to claim 1, further comprising pulse generating means for generating a pulse every time said sheet supply means supplies a sheet-like object, and wherein said count means counts the pulse sent from said pulse generating means after said detection means detects the first sheet-like object.

5. A sheet supply control method for a printing press, comprising the steps of:

setting a distance between a sheet-like object supply position and a detection position to be longer than a predetermined supply interval of sheet-like objects;

supplying sheet-like objects from a sheet supply unit to a printing unit one by one with the predetermined supply interval;

detecting sheet-like objects supplied by said sheet supply unit:

counting sheet-like objects supplied by said sheet supply unit and detected by said detecting step;

stopping supply operation of said sheet supply unit when the count of counted sheet-like objects becomes equal to a difference between the count of sheet-like objects to be supplied to said printing unit and a count of sheets supplied since sheet supply operation of said sheet supply unit is started until a first sheet-like object supplied by said sheet supply unit is detected such that the count of sheet-like objects supplied by said sheet supply unit coincides with a preset count of sheet-like objects to be supplied to said printing unit.

6. A sheet supply control method for a printing press, characterized by comprising the steps of:

setting a distance between a sheet-like object supply position and a detection position to be shorter than a predetermined supply interval of the sheet-like object;

supplying sheet-like objects from a sheet supply unit to a printing unit one by one with the predetermined supply interval;

detecting a sheet-like object supplied first by said sheet supply unit:

counting sheet-like objects supplied by said sheet supply unit after the first sheet-like object supplied by said sheet supply unit is detected;

stopping supply operation of said sheet supply unit when the count of sheet-like objects becomes equal to the count of sheet-like objects supplied by said sheet supply unit.

7. A method according to claim wherein the preset count of sheet-like objects to be supplied to said printing unit is a printing count of sheet-like objects necessary for ink removing operation, performed prior to exchange to a new printing plate, that removes an ink film thickness distribution corresponding to an image of a previous printing plate.

8. A method according to claim wherein the preset count of sheet-like objects to be supplied to said printing unit is a printing count of sheet-like objects necessary for ink removing operation, performed prior to exchange to a new printing plate, that removes an ink film thickness distribution corresponding to an image of a previous printing plate.

9. An apparatus according to claim 2, wherein the count preset in said setting means is a printing count of sheet-like objects necessary for ink removing operation, performed prior to exchange to a new printing plate, that removes an ink film thickness distribution corresponding to an image of a previous printing plate.

10. An apparatus according to claim 2, further comprising pulse generating means for generating a pulse every time said sheet supply means supplies a sheet-like object; and wherein said count means counts the pulse sent from said pulse generating means after said detection means detects the first sheet-like object.

* * * * *